US006505958B2

(12) United States Patent
Ooms et al.

(10) Patent No.: US 6,505,958 B2
(45) Date of Patent: Jan. 14, 2003

(54) ELECTRIC LAMP/REFLECTOR UNIT

(75) Inventors: Leo Frans Maria Ooms, Turnhout (BE); Marcus Petrus Anna Jozef Van Opstal, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/781,380

(22) Filed: Feb. 12, 2001

(65) Prior Publication Data

US 2001/0022726 A1 Sep. 20, 2001

(30) Foreign Application Priority Data

Feb. 15, 2000 (EP) ..... 00200497

(51) Int. Cl.[7] ..... F21V 7/00; F21K 2/00; F01J 61/30

(52) U.S. Cl. ..... 362/296; 313/594; 313/113; 362/265

(58) Field of Search ..... 313/113, 234, 313/318.08, 318.11, 594, 601, 602; 362/261, 263, 296, 265, 341, 343, 226; 439/220

(56) References Cited

U.S. PATENT DOCUMENTS

| | | | | | |
|---|---|---|---|---|---|
| 2,633,548 | A | * | 3/1953 | Kramel | 313/113 |
| 5,387,800 | A | | 2/1995 | Kurtich et al. | |
| 5,506,464 | A | * | 4/1996 | Ooms | 313/113 |
| 5,789,850 | A | * | 8/1998 | Iwafuji et al. | 313/318.08 |
| 5,837,800 | A | * | 11/1998 | Suzuki et al. | 528/193 |
| 5,998,915 | A | * | 12/1999 | Scholz et al. | 362/263 |
| 6,198,223 | B1 | * | 3/2001 | Scholz | 313/623 |

FOREIGN PATENT DOCUMENTS

EP 0595412 A1 4/1994

* cited by examiner

*Primary Examiner*—Sandra O'Shea
*Assistant Examiner*—Bao Truong
(74) *Attorney, Agent, or Firm*—Frank Keegan

(57) ABSTRACT

An electric lamp/reflector unit has a molded reflector body that includes a hollow neck-shaped portion. The electric lamp further includes a lamp vessel, having a space in which an electric element is arranged, and is provided with a first and a second, opposed end portion which is fixed at its end portion within-the neck-shaped portion. Outer current conductors extending from the electric element are connected each to a respective contact member provided on the outer surface of the molded reflector body.

20 Claims, 2 Drawing Sheets

ELECTRIC LAMP/REFLECTOR UNIT

FIELD OF THE INVENTION

The invention relates to an electric lamp/reflector unit comprising:

a molded reflector body provided with a reflector portion having an optical axis, and with an outer surface, and integrally with said outer surface a hollow neck-shaped portion around the optical axis; and a concave reflecting inner surface between the neck-shaped portion and a light emission window transverse to the optical axis;

an electric lamp provided with a light-transmitting lamp vessel which is closed in a vacuumtight manner and has a cavity in which an electric element is arranged, and which has a first and a second end portion in mutual opposition, each with a seal through which a respective first and second current conductor connected to the electric element are passed from the lamp vessel to the exterior, the second current conductor being guided through an opening in the reflector portion to the outer surface and being connected to a contact member provided on the outer surface, while the electric lamp is fixed in the reflector body, with the first end portion in the neck-shaped portion, the cavity within the reflector portion, and the electric element on the optical axis.

BACKGROUND OF THE INVENTION

Such an electric lamp/reflector unit is known from EP 595412. Units of this kind may be used for projection purposes, for example film or slide projection, but they may also be used in projection TV equipment. Users of such projection equipment continuously strive for miniaturization so as to render this projection equipment lighter in weight and more easy to use. It is a disadvantage of the known lamp/reflector unit that it has comparatively large dimensions, whereby further miniaturization of said projection equipment and/or the use of the lamp/reflector unit in comparatively small projection equipment is rendered difficult.

SUMMARY OF THE INVENTION

It is an object of the invention to provide an electric lamp/reflector unit of the kind described in the opening paragraph which has comparatively small dimensions, while at least substantially the same lumen output is obtained from the unit.

According to the invention, this object is achieved in that the electric lamp/reflector unit of the kind described in the opening paragraph is characterized in that a further contact member, to which the first current conductor is connected, is provided on the outer surface of the reflector body. The further contact member is not present in an axially displaced position behind the reflector portion, as in the known unit, but lies on the outer surface of the reflector portion. If the unit is projected along the optical axis onto a plane perpendicular to the optical axis, contours of the unit in said plane are imaged. The further contact member will lie within the contours of the reflector body upon such a projection. The contact members on the outer surface accordingly do not lead to an enlargement of the unit in radial direction, while nevertheless a reduction in size of the unit in axial direction is realized. The use of this unit in projection equipment of smaller dimensions has become possible as a result. The equipment in which the unit is to be mounted comprises a terminal for the electrical connection of the unit to the equipment. In the unit according to the invention, the terminal does not lie axially behind the unit, but next to the unit, this in contrast to the known unit. The terminal will lie within the contours of the reflector body upon projection along the optical axis. A smaller axial dimension of the equipment can thus be realized without leading to an increase in the radial dimension of this equipment. The equipment may thus be smaller and lighter. The lumen output of the unit according to the invention has remained at least substantially the same as that of the known unit. The unit according to the invention offers the advantage of a higher lumen output over a unit in which the smaller dimension of the unit is achieved in that the reflector portion was reduced in axial direction.

It is favorable when the contact members for the first and for the second current conductor are identical in shape. A smaller number of different operations are required as a result for achieving an electrical contact between the contact members and the current conductors. The operations are also less diverse, which simplifies the assembly of the unit. Moreover, a comparatively inexpensive assembling process can be achieved in the case of an automated manufacture on a large scale.

In a favorable embodiment, the first current conductor is passed from the first end portion through the neck-shaped portion to the exterior, where it is connected to the further contact member on the outer surface of the reflector portion. The two contact embers may then lie at a comparatively large distance from one another, so that the risk of flash-over between these members and/or current conductors is very small. It is then possible to operate or (re)ignite a discharge arc at a high voltage in a comparatively safe manner.

In an alternative embodiment, the electric lamp/reflector unit is provided with a starting aid. Preferably, the starting aid is connected to the further contact member provided on the outer surface via a connection conductor which is passed through a further opening in the reflector portion. The risk of start delays during (re)ignition of the lamp and hazardous situations arising therefrom is reduced by the starting aid.

In a favorable embodiment, the reflector body of the unit is manufactured from a glass-ceramic material which is resistant to thermal shocks. Glass-ceramic material has a comparatively small coefficient of thermal expansion, which is substantially zero in a temperature range from 20 to 500° C. Such a glass-ceramic material is obtained through partial crystallization of glass. The use of the reflector body manufactured from such a material improves the thermal shock resistance of the reflector body. It was also found that the reflector body has a higher temperature resistance and is better resistant to a possible explosion of the lamp. The use of the reflector body at a comparatively high temperature, for example up to approximately 700° C. instead of 450° C. as in the case of a glass reflector body, has thus become possible, and the safety of the unit has been improved.

The neck-shaped portion renders it possible to secure the lamp vessel therein circumferentially to the reflector body, for example with an adhesive compound, for example with cement such as, for example, lamp cement. The adhesive compound for fastening the lamp in the neck-shaped portion, however, restricts a ventilation in the space inside the reflector body. This is why the reflector body may have a profiled, for example ribbed outer surface. This increases the surface area of the outer surface, which makes for a stronger heat transfer.

The electric element may be an incandescent body, for example in an inert gas comprising halogen, or a pair of electrodes in an ionizable gas.

An electric lamp/reflector unit is known from U.S. Pat. No. 5,387,800 in which the lamp is positioned transversely to the optical axis of the reflector. The seals of the lamp project through the reflector portion to outside the reflector. A shortening of the unit in axial direction is achieved through this orientation of the lamp in the reflector. A disadvantage of the unit is, however, that the dimension in radial direction has increased. An additional disadvantage of this unit is that the lumen output is comparatively small and that comparatively much scattering of light occurs. This is caused on the one hand by the fact that the seals of the lamp absorb and/or scatter comparatively much of the light reflected by the reflector. On the other hand, this is caused by the fact that holes are provided in the reflector portion comparatively close to the neck-shaped portion for allowing the seals to project to the exterior.

BRIEF DESCRIPTION OF THE DRAWINGS

Embodiments of the electric lamp/reflector unit according to the invention are diagrammatically shown in the drawing, in which.

DETAILED DESCRIPTION OF THE PREFERRED EMBODIMENTS

Figure 1:
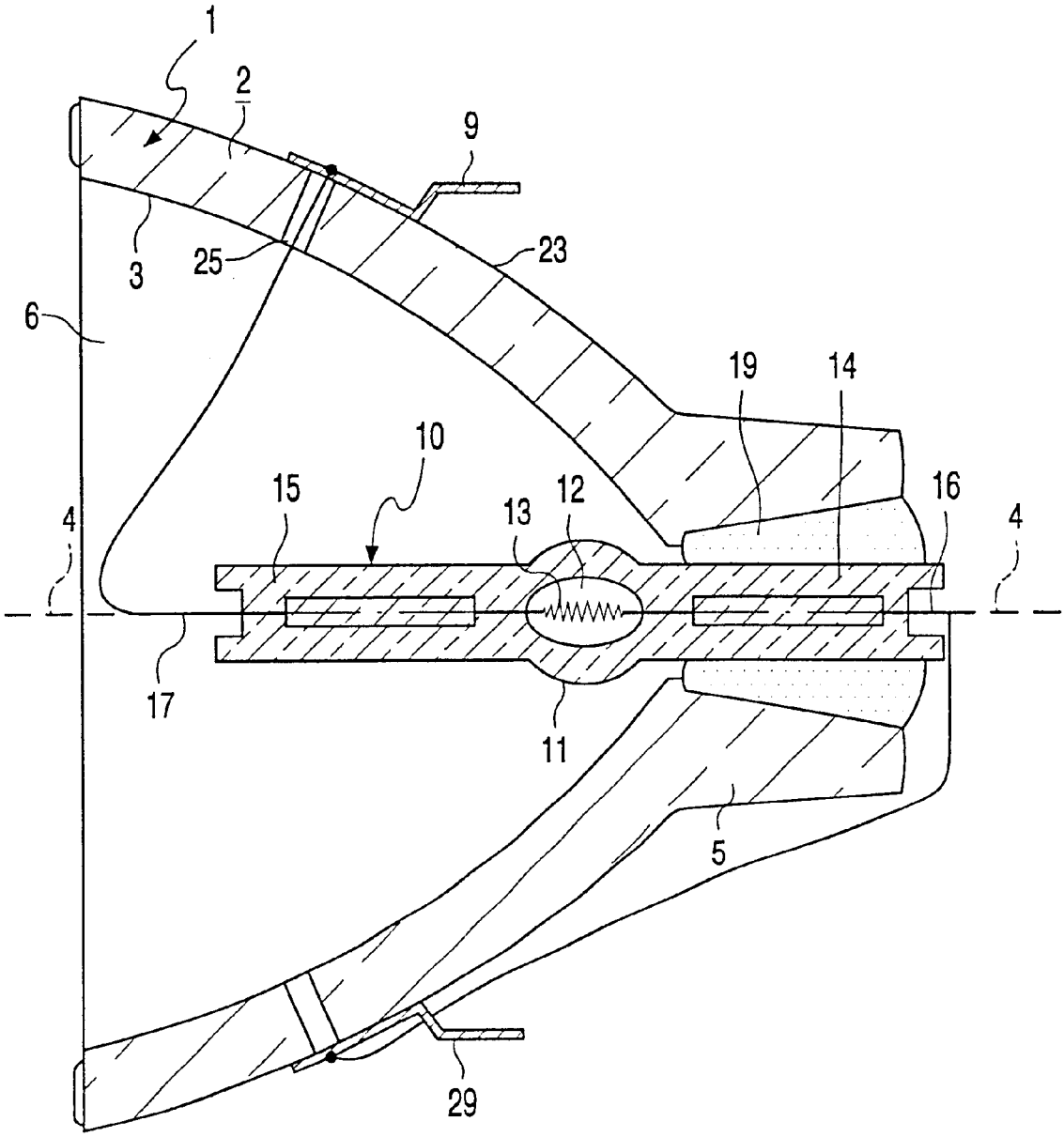
FIG. 1 shows a first embodiment in axial sectional view.

In FIG. 1, the electric lamp/reflector unit has a molded reflector body 1 which is provided with a reflector portion 2 with an optical axis 4 and with an outer surface 23, and integrally with the outer surface 23 a hollow neck-shaped portion 5 surrounding the optical axis 4. The reflector portion 2 further comprises a concave, for example paraboloidally curved, reflecting inner surface 3 between the neck-shaped portion 5 and a light emission window 6 which is transverse to the optical axis 4. In an alternative embodiment, however, said inner surface 3 may be, for example, ellipsoidally shaped. The reflector body 1 in the drawing is made of a glass-ceramic material and has a metal layer, for example an aluminum layer, serving as a mirror. The body 1 may alternatively be made, for example, of glass, metal, or synthetic resin. The unit also comprises an electric lamp 10 which is provided with a light-transmitting lamp vessel 11, for example made of quartz glass or alternatively of ceramic material, for example densely sintered aluminum oxide, which is closed in a vacuumtight manner. Quartz glass is glass having an $SiO_2$ content of at least 95% by weight. The lamp vessel 11 has a cavity 12 in which an electric element 13, an incandescent body in the Figure, is positioned. The lamp vessel 11 has a first 14 and a second, opposed end portion 15 with seal, through which a respective first 16 and second current conductor 17 are passed, which conductors are connected to the electric element 13 and issue from the lamp vessel 11 to the exterior. The lamp 10 shown has an incandescent body 13 and a filling, for example a filling of rare gas such as, for example, xenon, for example at a pressure of several bar, for example 7 bar, in the non-operational state, and one or several metal halides, possibly with mercury. The electric lamp 10, which dissipates approximately 35 W, is fixed in the reflector body 1, with cement 19 in the Figure, such that the first end portion 14 lies in the neck-shaped portion 5, the cavity 12 within the reflecting portion 2, and the electric element 13 on the optical axis 4.

The current conductor 17 issuing from the second end portion 15 is passed through an opening 25 in the reflector portion 2 to the exterior, where it is connected to a contact member 9 provided on the outer surface 23 of the reflector portion 2. The current conductor 16 is passed from the first end portion 14 through the neck-shaped portion 5 to the exterior, where it is connected to a further contact member 29 on the outer surface 23 of the reflector portion 2.

Figure 2:
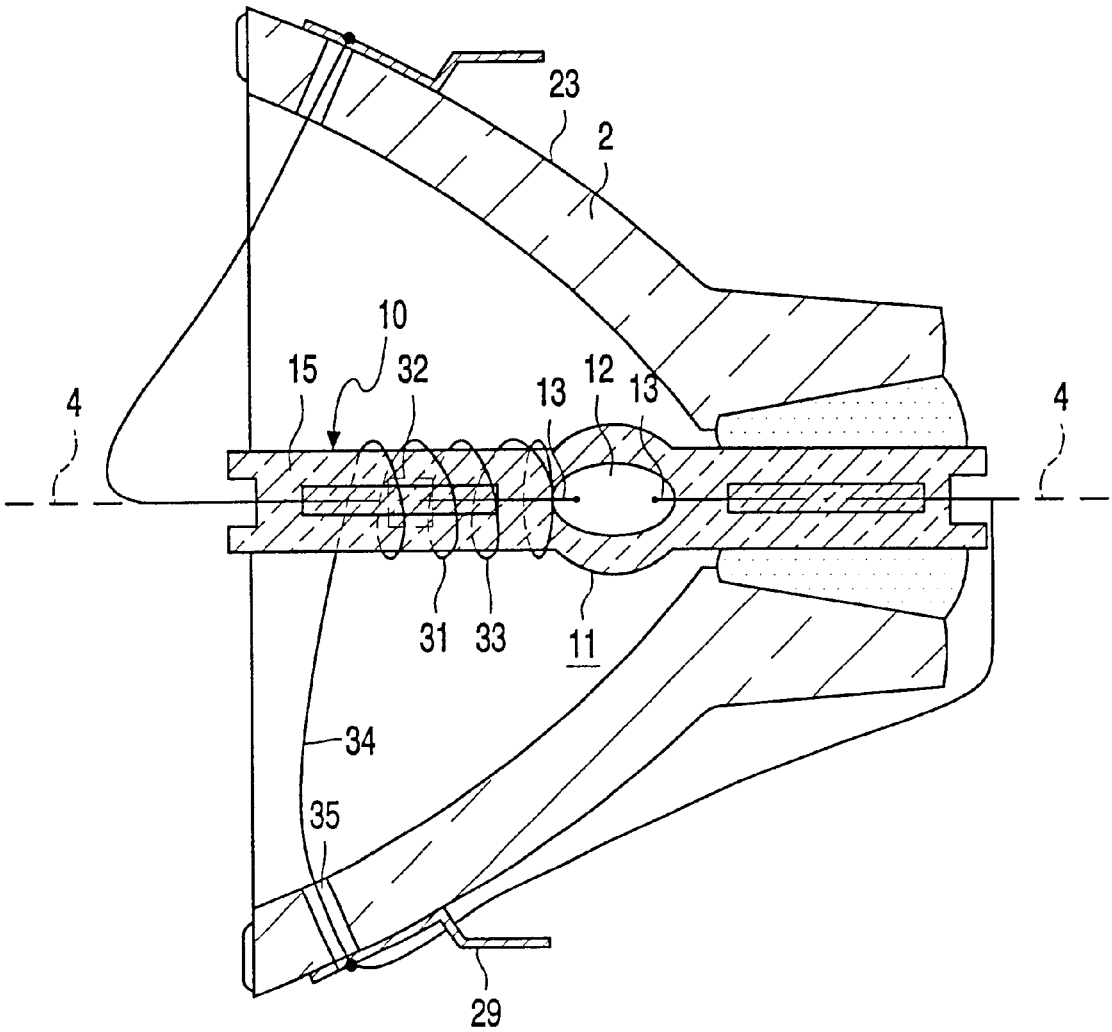
FIG. 2 shows a second embodiment in axial sectional view.

In FIG. 2, parts corresponding to parts in FIG. 1 have been given the same reference numerals. The lamp 10 shown is a high-pressure mercury gas discharge lamp which has a pressure of approximately 180 bar or more during operation. A pair of electrodes 13 is positioned on the optical axis 4 in the cavity 12 of the lamp vessel 11 which contains mercury and a rare gas, for example argon, and bromine. The electric lamp 10 has a power rating of between approximately 70 and approximately 150 W. The electric lamp/reflector unit is provided with a starting aid 31. The starting aid 31 comprises a gas-filled cavity 32 in the second end portion 15 of the lamp 10. The cavity 32 comprises at least one gaseous ingredient of the filling, for example mercury vapor. The starting aid 31 further comprises an external antenna 33 adjacent the second end portion 15 at the area of the cavity 32. The antenna 33 is wound a few turns around the second end portion 15. The number of turns is at least one. The antenna 33 comprises a connection conductor 34 which is passed through a further opening 35 in the reflector portion 2 and is connected to the further contact member 29 provided on the outer surface 23.

What is claimed is:

1. An electric lamp/reflector unit comprising:

a molded reflector body provided with a reflector portion having an optical axis, and with an outer surface, and integrally with said outer surface a hollow neck-shaped portion around the optical axis;

a concave reflecting inner surface between the neck-shaped portion and a light emission window transverse to the optical axis;

an electric lamp provided with a light-transmitting lamp vessel which is closed in a vacuumtight manner and has a cavity in which an electric element is arranged, the electric element having a first and a second end portion in mutual opposition, the length of the electric element between the first and second end portions being substantially aligned with the optical axis, each said first and second end portion having a seal through which a respective first and second current conductor connected to the electric element are passed from the lamp vessel to the exterior, the second current conductor being guided through an opening in the reflector portion to the outer surface and being connected to a contact member provided on the outer surface, while the electric lamp is fixed in the reflector body, with the first end portion in the neck-shaped portion of the cavity within the reflector portion, the first current conductor extending to the exterior of the lamp through the neck shaped portion, wherein a further contact member, to which the first current conductor is connected, is provided on the outer surface of the reflector body.

2. An electric lamp/reflector unit as claimed in claim 1, wherein the contact member and the further contact member are identical in shape.

3. An electric lamp/reflector unit as claimed in claim 1, wherein the first current conductor is passed from the first end portion through the neck-shaped portion to the exterior, where it is connected to the further contact member on the outer surface of the reflector portion.

4. An electric lamp/reflector unit as claimed in claim 1, wherein the electric lamp/reflector unit is provided with a starting aid.

5. An electric lamp/reflector unit comprising:

a molded reflector body provided with a reflector portion having an optical axis, and with an outer surface, and, integrally with said outer surface, a hollow neck-shaped portion around the optical axis;

a concave reflecting inner surface between the neck-shaped portion and a light emission window transverse to the optical axis;

an electric lamp provided with a light-transmitting lamp vessel closed in a vacuumtight manner and having a cavity in which an electric element is arranged, said electric lamp having a first and a second end portion in mutual opposition, each with a seal through which a respective first and second current conductor connected to the electric element are passed from the lamp vessel to the exterior, the second current conductor being guided through an opening in the reflector portion to the outer surface and being connected to a contact member provided on the outer surface, the electric lamp being fixed in the reflector body, and the first end portion in the neck-shaped portion, the cavity within the reflector portion and the electric element being on the optical axis, a further contact member on the outer surface of the reflector body connected to the first current conductor, the electric lamp/reflector unit being provided with a starting aid, and the starting aid being connected to the further contact member provided on the outer surface via a connection conductor which is passed through a further opening in the reflector portion.

6. An electric lamp/reflector unit as claimed in claim 1, wherein the reflector body is manufactured from a glass-ceramic material which is resistant to thermal shocks.

7. An electric lamp/reflector unit comprising:

a reflector body and an electric lamp;

the reflector body being provided with a reflector portion having an optical axis, an outer surface having a portion opposite said optical axis and a concave reflecting inner surface;

the electric lamp being provided with a light-transmitting lamp vessel which is closed in a vacuumtight manner and has a cavity in which an electric element is arranged, said electric element being connected to a first current conductor and a second current conductor; said first and second current conductors passing from the lamp vessel to the exterior of the lamp vessel;

the second current conductor extending from a second end portion of the lamp and being connected to a contact member provided on the portion of the outer surface opposite said optical axis;

the first current conductor extending from an end of the lamp and being connected to a further contact member on the portion of the outer surface opposite said optical axis.

8. An electric lamp/reflector unit as claimed in claim 7, wherein the contact member and the further contact member are identical in shape.

9. An electric lamp/reflector unit comprising:

a reflector body and an electric lamp;

the reflector body being provided with a reflector portion having an optical axis, an outer surface having a portion opposite said optical axis and a concave reflecting inner surface;

the electric lamp being provided with a light-transmitting lamp vessel which is closed in a vacuumtight manner and has a cavity in which an electric element is arranged, said electric element being connected to a first current conductor and a second current conductor; said first and second current conductors passing from the lamp vessel to the exterior of the lamp vessel;

the second current conductor extending from a second end portion of the lamp and being connected to a contact member provided on the portion of the outer surface opposite said optical axis;

the first current conductor being connected to a further contact member on the portion of the outer surface opposite said optical axis, the electric lamp/reflector unit being provided with a starting aid, the starting aid being connected to the further contact member provided on the outer surface via a connection conductor passing through the reflector portion.

10. An electric lamp/reflector unit as claimed in claim 9, wherein the starting aid comprises an external antenna adjacent to the second end portion of the lamp and a gas filled cavity in the second end portion, said cavity having a filling which includes at least one gaseous ingredient which is the same as a filling of the lamp vessel cavity, the antenna comprising a portion of the connection conductor.

11. An electric lamp/reflector unit as claimed in claim 7, wherein the reflector body is manufactured from a glass-ceramic material and operates a temperature between 450° C. and 700° C.

12. An electric lamp/reflector unit as claimed in claim 7, wherein in the reflector body has a profiled outer surface.

13. A lamp unit comprising:

a reflector having an outer surface;

a lamp located within said reflector, said lamp having a first end and a second end;

a first current conductor having a first first current conductor end and a second first current conductor end, said first first current conductor end being connected to said lamp;

a second current conductor connected to said lamp having a first second current conductor end, said first second current conductor end being connected to said lamp; and a first contact member and a second contact member provided on said outer surface; wherein said second first current conductor end and said second second current conductor end are connected to said first contact member and said second contact member, respectively.

14. The lamp unit of claim 13, wherein said first current conductor passes through a first portion of said reflector to contact said first contact member; and said second current conductor passes through a second portion of said reflector to contact said second contact member.

15. The lamp unit of claim 14, wherein said first portion includes a first opening at a neck of said reflector and said second portion includes a second opening at a side of said reflector.

16. A lamp unit comprising:

a reflector having an outer surface;

a lamp located within said reflector;

a first current conductor and a second current conductor having first ends and second ends, said first ends being connected to said lamp;

a first contact member and a second contact member provided on said outer surface;

said second ends being connected to said first contact member and said second contact member, respectively;

said first current conductor passing through a first portion of said reflector to contact said first contact member; and said second current conductor passing through a second portion of said reflector to contact said second contact member;

further comprising a starting aid connected to said first contact member via a connection conductor passing through a third portion opening at a side of said reflector.

17. The lamp unit of claim 13, wherein the first contact member and a second contact member are identical in shape.

18. The lamp unit of claim 13, further comprising a starting aid connected to the first contact member via a connection conductor passing through the reflector.

19. A lamp unit comprising:

a reflector having an outer surface;

a lamp located within said reflector;

a first current conductor and a second current conductor having first ends and second ends, said first ends being connected to said lamp;

a first contact member and a second contact member provided on said outer surface, said second ends being connected to said first contact member and said second contact member, respectively;

further comprising a starting aid connected to the first contact member via a connection conductor passing through the reflector; and the starting aid comprising an external antenna and a gas filled cavity, said cavity having a filling which includes at least one gaseous ingredient which is the same as a filling of the lamp vessel cavity.

20. The lamp unit of claim 13, wherein the reflector is manufactured from a glass-ceramic material and operates a temperature between 450° C. and 700° C.

* * * * *